US005699636A

United States Patent [19]

Stark

[11] Patent Number: 5,699,636

[45] **Date of Patent: *Dec. 23, 1997**

[54] EXTRUDED WINDOW JAMB LINER WITH YIELDABLE SEALING MEANS

[75] Inventor: Ivan L. Stark, Ada, Mich.

[73] Assignee: Newell Manufacturing Company, Lowell, Mich.

[ * ] Notice: The term of this patent shall not extend beyond the expiration date of Pat. No. 5,526,608.

[21] Appl. No.: 548,312

[22] Filed: Nov. 1, 1995

Related U.S. Application Data

[63] Continuation-in-part of Ser. No. 352,536, Dec. 9, 1994, Pat. No. 5,526,608.

[51] Int. Cl.[6] ..... E05D 13/00

[52] U.S. Cl. ..... 49/419; 49/414

[58] Field of Search ..... 49/414, 419, 428, 49/429, 43; 16/197, 199

[56] References Cited

U.S. PATENT DOCUMENTS

| | | | |
|---|---|---|---|
| 3,078,523 | 2/1963 | Martin | 20/52 |
| 3,145,433 | 8/1964 | Jones | 20/52 |
| 3,184,016 | 5/1965 | Smith et al. | 189/75 |
| 3,203,053 | 8/1965 | Lane et al. | 20/56.5 |
| 3,399,490 | 9/1968 | Hettinger | 49/414 |
| 3,441,978 | 5/1969 | Perry | 16/197 |
| 3,442,059 | 5/1969 | Kessler | 52/399 |
| 3,553,916 | 1/1971 | Lickliter et al. | 52/281 |
| 3,744,199 | 7/1973 | Navarre | 52/211 |
| 3,924,373 | 12/1975 | Lizdas | 52/213 |
| 3,998,027 | 12/1976 | Wendt et al. | 52/716 |
| 4,005,558 | 2/1977 | Barrison | 52/213 |
| 4,034,514 | 7/1977 | Cecil | 49/504 |
| 4,266,387 | 5/1981 | Karlsson | 52/731 |
| 4,470,222 | 9/1984 | Killingsworth | 49/419 |
| 4,726,148 | 2/1988 | Tix | 49/453 |
| 5,199,219 | 4/1993 | Martini et al. | 49/428 |
| 5,265,308 | 11/1993 | May et al. | 16/197 |
| 5,375,376 | 12/1994 | Scott | 49/480.1 |
| 5,526,608 | 6/1996 | Stark | 49/419 |

FOREIGN PATENT DOCUMENTS 1006620 10/1965 United Kingdom .

OTHER PUBLICATIONS

Exhibit A is a product brochure entitled "Jambliner/Balance Assemblies" published by Intek Weatherseal Products, Inc., Hastings, Minnesota 55033–2299, publication date unknown, which discloses a jamb liner including a pair of flexible hinge legs each supported by a tubular hinge arrangement.

*Primary Examiner*—Jerry Redman
*Attorney, Agent, or Firm*—Price, Heneveld, Cooper, DeWitt & Litton

[57] ABSTRACT

A jamb liner is provided for a window assembly including a frame and a sash operably mounted in the frame by use of the jamb liner. The jamb liner includes a sash-engaging portion having at least one pair of opposing wall sections and a bottom wall section defining a channel. An air-sealing portion extends from the opposing wall section for sealingly engaging the frame to prevent undesired flow of air between the jamb liner and the window frame. The air-sealing portion includes a root wall section that extends at an angle to one of the opposing wall sections, a resilient wall section that extends from the root wall section, and a frame-engaging wall section that extends from the resilient wall section. The resilient wall section connects the root wall section to the frame-engaging section and has a thickness which is generally greater than that of the root wall section and frame-engaging wall section, at least in certain areas, as well as a convexly curved outward configuration which is preferably larger and more extensive on one side than on the other, to provide improved biasing of the jamb liner between the jamb and the window sash which reliably and strongly urges the jamb liner toward the stiles of the sash whereby an enhanced weather seal is provided and maintained.

14 Claims, 1 Drawing Sheet

EXTRUDED WINDOW JAMB LINER WITH YIELDABLE SEALING MEANS

CROSS REFERENCE

This is a continuation-in-part application of U.S. patent application Ser. No. 08/352,536 filed Dec. 9, 1994, now U.S. Pat. No. 5,526,608.

BACKGROUND OF THE INVENTION

The present invention concerns a jamb liner for a window assembly, and more particularly concerns a jamb liner configured to provide an air seal against a window frame despite dimensional variations between the window frame and the jamb liner.

Many window frame assemblies include a frame, a jamb liner and a resilient foam block positioned between the jamb liner and the window frame to fill gaps between the jamb liner and the window frame and to thus reduce the flow of air through the window assembly. However, the foam often loses its resiliency over time and takes a permanent set, thus leading to undesirable air leaks. Also, foam can allow the jamb liner to bow, which results in inconsistent and possibly inadequate or excess operational forces on a slidable sash operably positioned in the window assembly. Still further, foam can make the jamb liner more difficult to install.

U.S. Pat. No. 5,265,308 discloses four different jamb liners in FIGS. 1–2, FIGS. 3–4, FIGS. 5–6 and FIG. 7, each having a relatively stiff strip-like member connected to the rear of the jamb liner by a co-extruded spring hinge member comprising resilient material. In the embodiments of FIGS. 1–2, FIGS. 5–6 and FIG. 7, the resilient material is located directly adjacent (extends contiguously along) the rear of a wall defining a sash-engaging guideway in the jamb liner, and in the embodiment of FIGS. 3–4, the resilient material extends contiguously along the rear of a wall defining a close-out/attachment panel at the lateral edge of the jamb liner. In each case, the resilient material extends directly along and immediately adjacent an outer surface of a wall of the jamb liner; however, this can cause several undesirable results which adversely affect the appearance and/or functionality of the wall as well as the operation of the hinge sought to be implemented. Further, this type of arrangement includes a structurally complex elongated hollow tube and or cylinder to which one edge of a finlike strip is attached, such that the tube or cylinder actually provides the bending hinge action. This is believed unduly complex and difficult to co-extrude in a continuous unwarped profile due to differential cooling rates of the resilient material of the hinge and the stiff material of the jamb liner. Another difficulty with such jamb liners is that the resilient hinge members are positioned at an outermost edge of the jamb liner, next to the frame, where they can be contacted by and compressed between the jamb liner and the window frame, which is undesirable.

U.S. patent application Ser. No. 5,526,608 now U.S. Pat. No. 5,526,608, by the present inventor, describes a jamb liner for a window assembly including a sash-engaging portion defining a channel for guiding movement of the sash frame, an air-sealing portion connected to the sash-engaging portion including a root wall section extending from the sash-engaging portion, a resilient wall section extending from the root wall section, and a frame-engaging wall section extending from the resilient wall section. The resilient wall section is described as being preferably about the same thickness as the root wall section and the frame-engaging section to facilitate the extruding process. While the resilient hinge member disclosed in this related U.S. Patent is believed to be an improvement over other known jamb liners such as that disclosed in earlier U.S. Pat. No. 5,265,308, it has since been determined that improved weather sealing properties and more uniform biasing of the jamb liners against the stiles of the window sash are possible, and that an improved connection between the root wall section and the frame-engaging wall section can also be achieved.

Thus, an improved jamb liner is desired that provides a resilient hinge member spaced from the sash-engaging or main portion of a jamb liner, which will provide more uniform urging of the jamb liners against the stiles along substantially the entire length thereof, and an improved connection between the sash-engaging or main portion of the jamb liner and the resilient hinge member.

SUMMARY OF THE INVENTION

The invention includes a jamb liner for a window assembly having a frame and a sash operably mounted in the frame. The jamb liner includes a sash-engaging portion defining a channel for guiding movement of the sash in the frame. The jamb liner further includes an air-sealing portion connected to the sash-engaging portion including a root wall section extending from the sash-engaging portion, a resilient wall section extending from the root wall section, and a frame-engaging wall section extending from the resilient wall section. The resilient wall section, which is comprised of an elastomeric material that connects the root wall section to the frame-engaging wall section, has a thickness which is generally greater than that of the root wall section and frame-engaging wall section. The resilient wall section preferably has a thickness which is greatest along the plane between the root wall section and the frame-engaging wall section, and most preferably the thickness of the resilient wall section is greatest along a plane which is approximately equal distance between the root wall section and the frame-engaging wall section.

In order to improve the connection between the root wall section and frame-engaging wall section which is provided by the resilient wall section, the resilient wall section is desirably connected to the root wall section and frame-engaging wall section at mutually facing edges thereof and at opposing outer side wall surfaces thereof. This is to say, the resilient wall section desirably partially overlaps opposing outer side wall surfaces of the root wall section and the frame-engaging wall section. The resilient wall section also preferably has curved surfaces which project outwardly away from at least certain of the adjacent side wall surfaces of the root wall section and frame-engaging wall section. The resilient wall section has a portion which is under tension when installed on a window jamb, and a portion which is under compression when installed on a window jamb. Preferably, the portion of the resilient wall section which is under tension when installed on a window jamb projects further outwardly from the wall surfaces on one side of the root wall section and frame-engaging wall section than the portion which is under compression when installed on a window jamb. That is, the resilient wall section is preferably thicker on one side than the other side. The increased thickness of the resilient wall section provides improved biasing, whereby the sash-engaging section is urged against the sash with greater force and improved weather sealing is achieved. The resilient wall section positions the frame-engaging wall section in a position spaced from the bottom of the sash-engaging wall section. The resilient wall section biases the frame-engaging wall section away from the bottom of the sash-engaging portion such that the frame-engaging wall section seals against the frame substantially along the entire length of the jamb liner to prevent undesired flow of air between the jamb liner and the frame. The root wall section also reinforces a wall on the sash-engaging portion to prevent longitudinal distortion thereof, such as during cooling, and still further spaces the resilient wall section away from the sash-engaging portion to facilitate co-extrusion of the jamb liner and to prevent the resilient wall section from undesirably affecting the aesthetics and/or functionality/shape of the sash-engaging portion. In certain embodiments the overall configuration and positioning of the wall sections provides an automatic positive limiting effect for the resilient hinging, and in other embodiments a desirable extended, broad-based hinge structure is provided by which a gradual, consistent biasing effect is obtained.

These and other features and advantages of the present invention will be recognized by those who practice the invention and by those skilled in the art, based on a thorough reading in view of the specification, claims and appended figures.

DETAILED DESCRIPTION OF PREFERRED EMBODIMENTS

Figure 1:
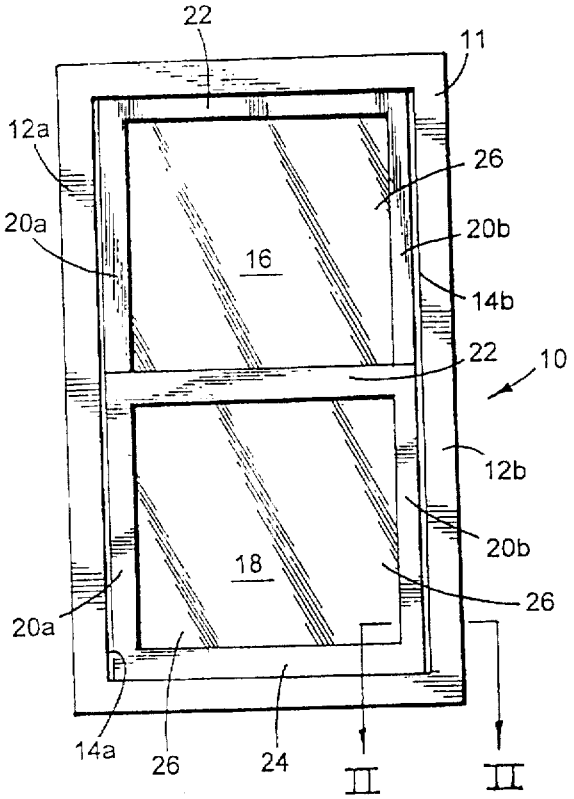
FIG. 1 is a front elevational view of a window assembly including an extruded window jamb liner embodying the present invention.

Shown in FIG. 1 is window 10 incorporating the extruded window jamb liner of the invention. The window 10 comprises a frame 11, including a pair of jambs 12*a*, 12*b*, a pair of jamb liners 14*a*, 14*b* which are fixably secured to jambs 12*a*, 12*b*, respectively, an upper and lower sashes 16, 18 respectively, which are mounted for sliding vertical movement between jamb liners 14*a*, 14*b*. Sashes 16 and 18 each comprise side stiles 20*a*, 20*b*, top rail 22 and bottom rail 24 which frame a glass windowpane 26.

The features of jamb 12*a*, jamb liner 14*a* and stile 20*a* are generally similar to, or substantially the same as, those of jamb 12*b*, jamb liner 14*b* and stile 20*b*, respectively; consequently the jambs, jamb liners, stiles and other features will be described in detail with reference to the lower right-hand portion of window 10 as shown in FIG. 1, the features of jamb 12*a*, jamb liner 14*a*, and stile 20*a* being apparent therefrom. Jamb liners 14*a* and 14*b* are preferably plastic extrusions having a constant cross-sectional profile, such as that shown in FIG. 2. Jamb liners 14*a*, 14*b* each include a pair of substantially identical channels 28*a*, 28*b* defined by back wall 30, opposite side walls 32, 33, and laterally spaced front wall portions 34, 35. The spacing between wall portions 34 and 35 define an elongate vertical slot 36. Jamb liners 14*a*, 14*b* have a general facing or web level defined by central web portions 38, 39 and outer web portions 40, 41. Jamb liners 14*a*, 14*b* also include side walls 42, 43 and flange portions 44, 45 which extend outwardly from the base of side walls 42, 43, respectively. A portion of channels 28*a* and 28*b* extends beyond the general level of jamb liners 14*a*, 14*b* defined by webs 38, 39, 40, 41 toward stiles 20*a*, 20*b*. Stile 20*b* includes a plow or vertical groove 46 which extends continuously along the height thereof. The portion of channels 28*a*, 28*b* which projects forwardly toward the window opening are closely and proximately received within groove 46 of stiles 20*a*, 20*b*, whereby sashes 16, 18 track vertically on jamb liners 14*a*, 14*b*. Closely or proximately received within each of the channels 28*a* and 28*b* is a frictional positioner shoe 50 which is slidably received within channel 28*b*.

Figure 2:
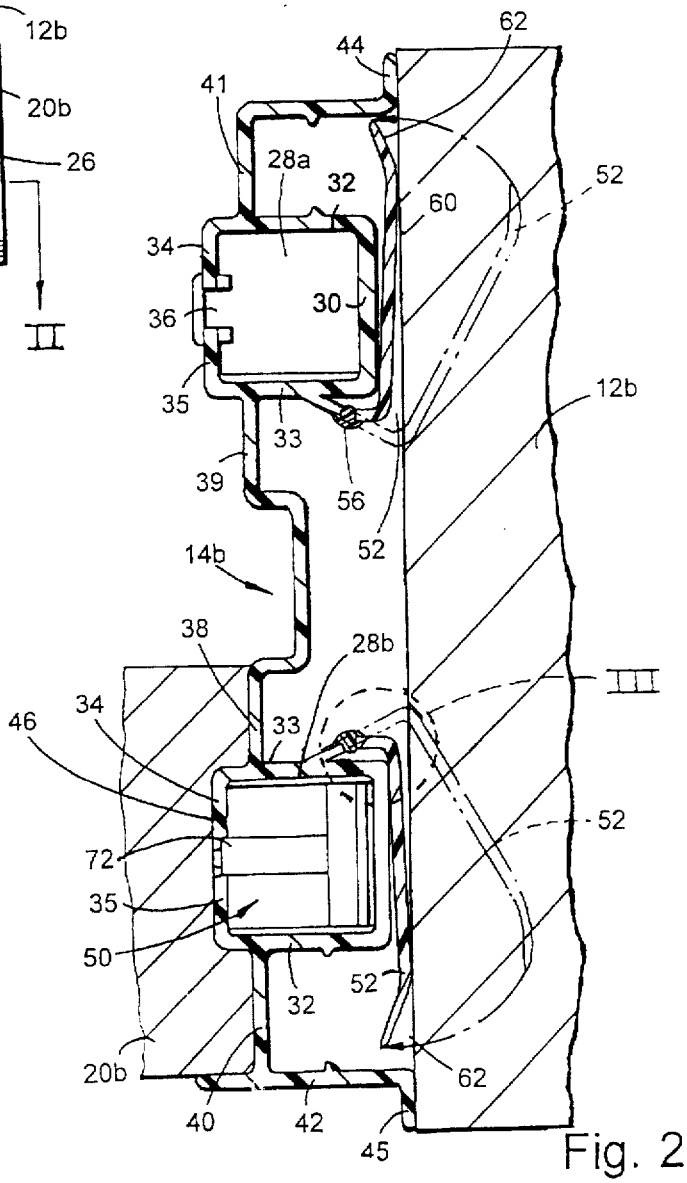
FIG. 2 is a fragmentary, cross-sectional view along lines II—II of FIG. 1.

As shown in FIG. 2, jamb liners 14*a* and 14*b* preferably include a pair of resiliently biased elongated flanges or arms 52 which are shown in their relaxed or prestressed condition in phantom outline in FIG. 2. Upon mounting of jamb liners 14*a*, 14*b* to jambs 12*a*, 12*b*, arms 52 are moved resiliently (flexed) toward channels 28*a*, 28*b* as shown in solid outline in FIG. 2. Upon mounting of jamb liners 14*a*, 14*b* to jambs 12*a*, 12*b*, an air-sealing and resiliently biased portion 51 extends from the opposing side walls 32, 33 for sealingly engaging frame 11 to prevent undesirable flow or leakage of air between jamb liners 14*a*, 14*b* and frame 11. The air-sealing portion includes a root wall section 54 that extends at about a 45° angle with respect to the opposing side wall 33, and generally from the center thereof. The 45° angle optimizes stress distribution in air-sealing portion 51 relative to wall section 33. Air-sealing portion 51 further includes a resilient wall section 56 that extends from the root wall section 54, and a frame-engaging wall section 52 that extends from the resilient wall section 56.

Frame-engaging wall section 52 is L-shaped, and includes a first leg 58 that aligns co-extensively with root wall section 54 and resilient wall section 56, and a frame-engaging second leg 60 that extends generally perpendicular to first leg 58. An outer edge 62 of second leg 60 is arcuately shaped to provide a relatively wide contact area for sealing against frame 11. The wide contact area provides good closure against frame 11 regardless of the relative angle of second leg 60 to frame 11. In particular, the arcuate shape defines a longer, more tortuous path for air leaked between edge 62 and frame 11 even if frame 11 includes a local defect causing a minor local gap between outer edge 62 and frame 11.

Jamb liners 14*a*, 14*b* are co-extruded of a flexible resilient material making up resilient wall section 56, and a structural, generally ridged PVC material making up the remaining wall sections 30, 32, 33, 34, 35, 38, 39, 40, 41, 42, 43, 44, 45, 52, and 54. The preferred flexible material is a thermoplastic elastomer having a Shore Hardness of D50–D70, such as Estane™ material marketed by B.F. Goodrich Corporation. The resiliency of the flexible resilient material causes it to bias the frame-engaging wall section 52 against frame 11 substantially fully along the length of frame 11 despite dimensional variations in jamb liners 14*a*, 14*b* and frame 11. Also, the resilient material has a long life and does not tend to take a set over time.

In use, jamb liner 14*b* is attached to frame 11 with leg 60 located between back wall 30 and window frame 11. Resilient wall section 56 biases leg 60 against window frame 11 to take up any gap between back wall 30 and window frame 11, and thus prevent leakage of air therebetween. In those instances where window frame 11 locally juts toward back wall section 30, leg 60 may be forced flat against back wall section 30 across all or part of its width. Thus leg 60 may engage all of back wall section 30 from side to side, but does not cause back wall section 30 to unnecessarily twist or distort. Thus, channel 28*b* is not significantly distorted by such circumstances and does not cause interference with the free movement of the sash support member which travels along channel 28*b*. In fact, leg 60 supports and helps maintain back wall section 30 (and channel 28*b*) in a square position relative to window frame 11 and stile 20*b*.

Alternatively, leg 60 may be configured to contact back wall section 30 at an angle, whereby the extent of allowable motion and the corresponding hinging action is positively limited, without significant distortion of channel 28b.

Figure 3:
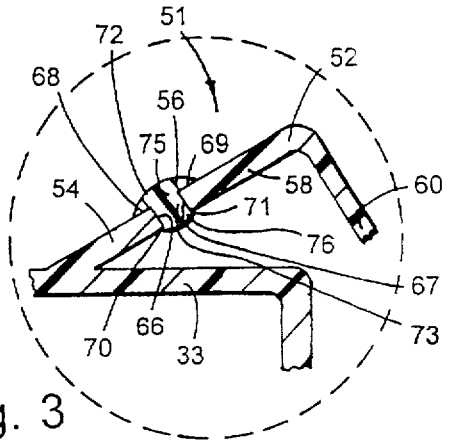
FIG. 3 is an enlarged view of the area designated III in FIG. 2.

As shown in FIG. 3, the resilient wall section 56 has at least portions whose thickness is generally greater than that of the root wall section and the frame-engaging wall section. The illustrated resilient wall section has a variable thickness which is greatest along a plane disposed between the root wall section 54 and the air-sealing portion 52. Desirably, the resilient wall section 56 has a variable thickness which is greatest along a plane disposed generally orthogonal to and located equal distance between the root wall section 54 and the air-sealing portion 52. The resilient wall section 56 is connected to the root wall section 54 and to the air-sealing portion 52 at mutually facing edges 66, 67 thereof, and also along outer side wall surfaces 68, 69, 70 and 71 which are adjacent edges 66, 67. The resilient wall section 56 is disposed between and partially overlaps opposing outer side wall surfaces 68, 70 of the root wall section 54 and outer side wall surfaces 69, 71 of the air-sealing portion 51. The resilient wall section 56 has surfaces 72, 73 which project outwardly away from at least certain of the adjacent side wall surfaces 68, 70 of the root wall section 54 and away from wall surfaces 69, 71 of the air-sealing portion 51.

It will be noted that projecting surfaces 72, 73 preferably define convex head portions which project outwardly relative to the adjacent side wall surfaces 68, 69, 70 and 71. The resilient wall section 56 includes a portion 75 which is under tension when flexed relative to a window jamb along which the jamb liner is mounted, and a portion 76 which is under compression when so mounted. More particularly, the first such portion includes outer sections which are under a combination of both tension and bending forces and inner sections which are under essentially direct tension. Similarly, the second such portion includes outer sections which are under a combination of both compression and bending forces and inner sections which are under essentially direct compression forces. The portion 75 of the resilient wall section 56, which is under tension when flexed, projects further outwardly from adjacent wall surfaces 68, 69 on one side of the root wall section 54 and air-sealing portion 52 than the opposite portion 76, which is under compression, projects outwardly from the opposite surfaces 70, 71 on the other side of the root wall section and frame-engaging wall section. The overlap between the resilient wall section 56 and root wall section 54 provides an improved, stronger connection therebetween, primarily on account of the increased area of contact between the resilient wall section 56 and the root wall section 54. Likewise, the overlap between resilient wall section 56 and air-sealing portion 51 provides an improved, stronger connection therebetween. Additionally, the increased and differentially varying thicknesses of the resilient wall section 56 and 75 relative to the root wall section 54 and the air-sealing portion 51 provides particularly engineered improved biasing whereby the sash-engaging portion of the jamb liner is more forcibly urged against the sashes to provide an improved weather seal.

The above description is considered that of the preferred embodiments only. Modification of the invention will occur to those skilled in the art and to those who make and use the invention. Therefore, it is understood that the embodiments shown in the drawings and described above are merely for illustrative purposes and are not intended to limit the scope of the invention, which is defined by the following claims.

The embodiments of the invention in which an exclusive property or privilege is claimed are defined as follows:

1. A jamb liner for a window assembly of a type including a frame and a sash operably mounted in the frame, comprising;

a sash-engaging portion defining a channel for guiding movement of the sash in the frame; and an air-sealing portion for positioning the jamb liner relative to said frame and for preventing flow of air therebetween, said air-sealing portion being connected to said sash-engaging portion and including a root wall section extending at an angle greater than zero degrees from said sash-engaging portion, a frame-engaging wall section, and a resilient wall section comprised of an elastomeric material extending in line between and connecting said root wall section to said frame-engaging wall section such that said frame-engaging wall section effectively forms a continuous wall with said root wall section and is disposed at a non-acute angle with respect thereto, said resilient wall section having at least portions whose thickness is generally greater than that of said root wall section and said frame-engaging wall section, said resilient wall section flexibly bending upon angular movement of said frame-engaging wall section with respect to said root wall to resiliently bias said frame-engaging wall section with respect to said sash-engaging portion to enhance sealing of said frame-engaging wall section against the frame to prevent undesirable flow of air between said jamb liner and the frame, and said resilient wall section portions of greater thickness augmenting such resilient bias effect during said bending.

2. The jamb liner of claim 1, wherein said resilient wall section has a variable thickness which is greatest along a plane disposed generally orthogonally to and between said root wall section and said frame-engaging wall section.

3. The jamb liner of claim 2, wherein said resilient wall section has a variable thickness which is greatest along a plane disposed generally orthogonal to and located approximately equidistant between said root wall section and said frame-engaging wall section.

4. The jamb liner of claim 1, wherein said root wall section and said frame-engaging wall section having mutually facing edges and outer side wall surfaces adjacent said edges; said resilient wall section connected to said root wall section and said frame-engaging wall section at the mutually facing edges thereof and also along the outer side wall surfaces thereof adjacent said edges.

5. The jamb liner of claim 4, wherein said resilient wall section is disposed between and partially overlaps opposing outer side wall surfaces of said root wall section and said frame-engaging wall section.

6. The jamb liner of claim 4, wherein said resilient wall section overlaps a wider area on one side of said root wall section and said frame-engaging wall section than it does on the other side thereof.

7. The jamb liner of claim 1, wherein said resilient wall section has a portion which is under tension when flexed relative to a window jamb along which the jamb liner is mounted, and a portion which is under compression when so mounted, said portion of said resilient wall section which is under tension when so mounted projecting further outwardly from adjacent wall surfaces on one side of said root wall section and said frame-engaging wall section than said portion which is under compression when so mounted.

8. The jamb liner of claim 1, wherein said sash-engaging portion includes opposing wall sections, and said root wall section extends at an angle from one of said opposing wall sections.

9. The jamb liner of claim 1, wherein said sash-engaging portion includes a back wall section and opposing wall sections, and wherein said frame-engaging wall section is L-shaped and includes a first leg positioned proximate one of said opposing wall sections and a second leg positioned proximate said back wall section, said second leg being configured to lay substantially flat against said back wall section when pressed thereagainst.

10. The jamb liner of claim 1, wherein said resilient wall section includes a thermoplastic elastomer having a Shore Hardness of about D50–D70.

11. The jamb liner of claim 1, wherein said sash-engaging portion includes opposing wall sections, and wherein said air-sealing portion includes a second resilient wall section, said first and second resilient wall sections operably connecting opposite ends of said frame-engaging wall section to said opposing wall sections.

12. A jamb liner for a window assembly of a type including a frame and a sash operably mounted in the frame, comprising;

a sash-engaging portion defining a channel for guiding movement of the sash in the frame; and an air-sealing portion for positioning the jamb liner relative to said frame and for preventing flow of air therebetween, said air-sealing portion being connected to said sash-engaging portion and including a root wall section extending from said sash-engaging portion, a frame-engaging wall section, and a resilient wall section comprised of an elastomeric material extending between and connecting said root wall section to said frame-engaging wall section, said resilient wall section having at least portions whose thickness is generally greater than that of said root wall section and said frame-engaging wall section, said resilient wall section flexing upon angular movement of said frame-engaging wall section with respect to said root wall to resiliently bias said frame-engaging wall section with respect to said sash-engaging portion to enhance sealing of said frame-engaging wall section against the frame substantially the entire length of said resilient wall section to prevent undesirable flow of air between said jamb liner and the frame; said root wall section and said frame-engaging wall section having mutually facing edges and outer side wall surfaces adjacent said edges; said resilient wall section being connected to said root wall section and said frame-engaging wall section at the mutually facing edges thereof and also along at least a portion of said outer side wall surfaces thereof.

13. A jamb liner for a window assembly of a type including a frame and a sash operably mounted in the frame, comprising;

a sash-engaging portion defining a channel for guiding movement of the sash in the frame; and an air-sealing portion for positioning the jamb liner relative to said frame and for preventing flow of air therebetween, said air-sealing portion being connected to said sash-engaging portion and including a root wall section extending from said sash-engaging portion, a frame-engaging wall section, and a resilient wall section comprised of an elastomeric material extending between and connecting said root wall section to said frame-engaging wall section, said resilient wall section having at least portions whose thickness is generally greater than that of said root wall section and said frame-engaging wall section, said resilient wall section flexing upon angular movement of said frame-engaging wall section with respect to said root wall to resiliently bias said frame-engaging wall section with respect to said sash-engaging portion to enhance sealing of said frame-engaging wall section against the frame substantially the entire length of said resilient wall section to prevent undesirable flow of air between said jamb liner and the frame; said root wall section and said frame-engaging wall section having mutually facing edges and outer side wall surfaces adjacent said edges; said resilient wall section being disposed between and partially overlapping opposing outer side wall surfaces of said root wall section and said frame-engaging wall section.

14. The jamb liner of claim 13, wherein said resilient wall section has surfaces which project outwardly relative to at least certain of the adjacent side wall surfaces of said root wall section and said frame-engaging wall section, and said projecting surfaces define convex head portions which project outwardly relative to said adjacent side wall surfaces.

* * * * *